US006361189B1

(12) United States Patent
Scholz

(10) Patent No.: US 6,361,189 B1
(45) Date of Patent: Mar. 26, 2002

(54) OPERATING THEATER LUMINAIRE INCLUDING DISCHARGE LAMPS WITHIN A REFLECTOR

(75) Inventor: Manfred Scholz, Seitingen-Oberflacht (DE)

(73) Assignee: Gebrueder Berchtold GmbH & Co., Tuttlingen (DE)

( * ) Notice: Subject to any disclaimer, the term of this patent is extended or adjusted under 35 U.S.C. 154(b) by 0 days.

(21) Appl. No.: 09/589,562

(22) Filed: Jun. 6, 2000

(30) Foreign Application Priority Data

Jun. 11, 1999 (DE) ..... 199 26 690

(51) Int. Cl.[7] ..... F21K 27/00

(52) U.S. Cl. ..... 362/263; 362/212; 362/236; 362/265; 362/295; 362/20; 315/362; 315/307

(58) Field of Search ..... 362/263, 212, 362/236, 265, 295, 20, 251, 238, 233, 232, 239; 315/362, 312, 325, 307, 308, 289, 290

(56) References Cited

U.S. PATENT DOCUMENTS

| | | | | |
|---|---|---|---|---|
| 3,997,816 A | | 12/1976 | Haugsjaa et al. | 315/267 |
| 4,041,352 A | | 8/1977 | McNeill et al. | 315/248 |
| 4,359,668 A | | 11/1982 | Ury | 315/39 |
| 4,423,471 A | | 12/1983 | Gordin et al. | 362/96 |
| 5,321,595 A | | 6/1994 | Jacobi et al. | 362/373 |
| 5,331,254 A | | 7/1994 | Cocoma et al. | 315/248 |
| 5,539,626 A | * | 7/1996 | Scholz | 362/249 |
| 5,582,479 A | | 12/1996 | Thomas et al. | 362/277 |
| 5,743,628 A | | 4/1998 | Greif | 362/228 |
| 5,791,768 A | | 8/1998 | Splane | 362/280 |
| 5,861,706 A | | 1/1999 | Lapatovich | 313/113 |
| 6,137,240 A | * | 10/2000 | Bogdan | 315/307 |

FOREIGN PATENT DOCUMENTS

| | | | |
|---|---|---|---|
| DE | 2506421 | | 8/1975 |
| DE | 3139425 | A1 | 4/1983 |
| DE | G8332680.4 | | 3/1984 |
| DE | 3507143 | C2 | 10/1985 |
| DE | 3611138 | A1 | 10/1987 |
| DE | 3813035 | C2 | 2/1989 |
| DE | 3807585 | A1 | 9/1989 |
| DE | 3935058 | A1 | 5/1990 |
| DE | G9016036.3 | | 3/1991 |
| DE | 4116049 | A1 | 12/1991 |
| DE | 4241911 | A1 | 6/1993 |
| DE | 3238876 | A1 | 4/1994 |
| DE | 4333448 | A1 | 7/1994 |
| DE | 4400199 | A1 | 7/1994 |
| DE | 19505925 | A1 | 8/1996 |
| DE | 19507305 | A1 | 9/1996 |
| DE | 29621603 | U1 | 5/1997 |
| DE | 19712584 | A1 | 10/1997 |
| DE | 29710936 | U1 | 11/1997 |
| DE | 29716393 | U1 | 1/1998 |
| DE | 19640625 | A1 | 4/1998 |
| DE | 19736189 | A1 | 2/1999 |
| DE | 29720592 | U1 | 7/1999 |
| EP | 0819836 | A2 | 1/1988 |
| EP | 0728987 | A2 | 8/1996 |
| EP | 0567925 | B1 | 3/1998 |
| WO | WO 98/57356 | | 12/1998 |

* cited by examiner

*Primary Examiner*—Sandra O'Shea
*Assistant Examiner*—Ronald E. DelGizzi
(74) *Attorney, Agent, or Firm*—Townsend and Townsend and Crew LLP

(57) ABSTRACT

An operating theater luminaire having at least two discharge lamps, which can be switched on and off, can be started and alternatively can be switched on by means of a starting device, and illuminate an operating area via optical means, in particular at least one reflector. A plurality of, in particular two discharge lamps, equipped with individual starting devices, of different powers are provided, as a result of which the intensity of illumination in the operating area can be varied when switching over from one discharge lamp to another.

18 Claims, 1 Drawing Sheet

OPERATING THEATER LUMINAIRE INCLUDING DISCHARGE LAMPS WITHIN A REFLECTOR

Figure 1:
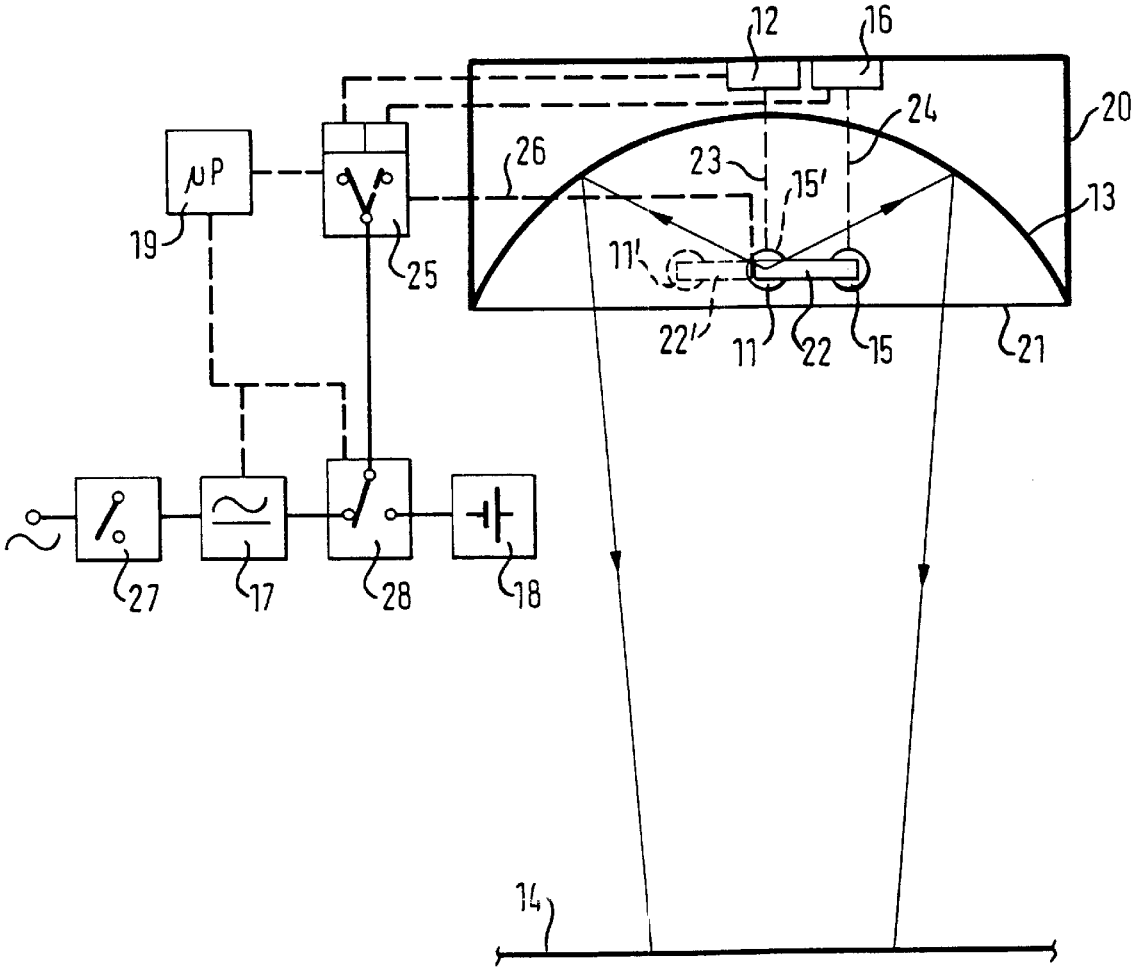

The invention relates to an operating theater luminaire having at least one discharge lamp which can be switched on and off, according to the preamble of Patent claims 1 and 3.

Many operating theater luminaires which work with the aid of discharge lamps are known (see, for example, U.S. Pat. No. 5,861,706) are known. Furthermore, it is already known for discharge lamps to be combined with incandescent lamps in a luminaire body (DE-A 31 39 425, EP-B 819 836, DE-A 36 11 138, DE-A 195 05 925).

Operating theater luminaires having incandescent lamps have the disadvantage that the development of heat inside the luminaire body is considerable, and this not only signifies an increased power consumption, but also is attended by the problem that the heat produced inside the luminaire body must be dissipated.

By contrast, the efficiency of discharge lamps is substantially higher, and their heat output is substantially reduced by comparison with that of incandescent lamps. A problem in the use of discharge lamps in operating theater luminaires consists, however, in that continuous or stepped brightness control is virtually impossible, and that in the event of failure of the discharge lamp a reserve light is available, if required, in the form of a heat-producing incandescent lamp.

Also already known is a luminaire having two high-intensity discharge lamps without electrodes (U.S. Pat. No. 5 861 706), in each case only one lamp arranged at the focal point of the reflector burning during operation, while the other is started when a short power failure comes about which causes an extinction of the discharge lamp currently alight. Since, because of its strong heating, this latter lamp cannot be immediately restarted upon subsequent restitution of the mains voltage, the second discharge lamp, arranged outside the focal point, must be started and take over at least temporarily the function of the actual operating lamp.

It is the object of the invention to create an operating theater luminaire of the generic type mentioned at the beginning in the case of which brightness control is possible in the operating area without the need for additional incandescent lamps.

The features of the characterizing part of Patent claim 1 are provided for the purpose of achieving this object.

The concept of the invention is therefore to be seen in that the brightness is controlled in the operating area by virtue of the fact that two or more discharge lamps of different power are optionally switched on. It is possible in this way to perform in the operating area brightness adjustment which, although not continuous, is stepped and entirely sufficient for practical purposes.

A preferred power grading is to be gathered from claim 2.

A further object of the invention consists in that in the event of failure of the discharge lamp currently alight, a fully usable reserve light is available for continuing the operation.

This can be performed by the measure of the characterizing part of claim 3 in the case of a luminaire both according to the preamble of claim 1 and according to that of claim 3.

By contrast with the arrangement according to U.S. Pat. No. 5 861 706, however, the additional discharge lamps of the same or different power serve the purpose of taking over the illumination of the operating area in the case that the discharge lamp currently alight has reached the end of its service life or is shortly before the end of the service life.

The function of the operational discharge lamp is taken over by the other discharge lamp or taken over by one of the other discharge lamps in this case.

In the case of the embodiment according to claim 1 or 2, as well, a suitable reserve light is ensured in the case of failure of a discharge lamp. Although there is a change in the intensity of illumination in the operating area in this embodiment in the case of the replacement of a failed discharge lamp by another, located in the same housing, there is nevertheless still sufficient light available to be able to conduct to the end an operation which is underway. In this case, for example, after the failure of one discharge lamp all the discharge lamps located in the luminaire body are to be exchanged.

The development according to claim 4 is particularly advantageous, because it is thereby achieved that all the discharge lamps are worn out uniformly, with the result that it makes sense after the termination of the service life of one of the discharge lamps for all the discharge lamps to be immediately replaced by new ones, as a result of which the operating theater luminaire is once again rendered fully operational. A particular advantage of the embodiment according to claim 4 consists in that the service life is lengthened in accordance with the number of the discharge lamps used. As a result, not only is the service interval provided for exchanging a lamp doubled by up to 10 years, but a reserve light which is of a quality fully identical with the lamp light which had just been switched on is continuously available in the case of failure of one of the plurality of, in particular two discharge lamps. To be precise, it is extremely unlikely that all the plurality of discharge lamps provided in the luminaire body will fail simultaneously, with the result that upon failure of one discharge lamp the second or another one located in the luminaire body can be used to replace the failed discharge lamp in order to take over the function thereof.

The design according to claim 5 is expedient in order to avoid interruption of the luminous flux during switching over from one discharge lamp to another.

The plurality of discharge lamps can be arranged in a stationary fashion in accordance with claim 6, or be arranged in a fashion capable of being adjusted in a common reflector, according to claim 7.

There is to be provided on the luminaire a display which signals the failure of a discharge lamp, whereupon all the discharge lamps located in the luminaire body are to be replaced by new ones. This ensures the luminaire operates in an absolutely fail safe fashion even in the case of the failure of a discharge lamp, without there being an impairment of the quality of the illumination of the operating area.

The invention is described below by way of example with the aid of the drawing, in which:

FIG. 1 shows in a purely diagrammatic fashion a first exemplary embodiment of an operating theater luminaire according to the invention.

According to FIG. 1, a reflector 13 which is sealed at the bottom by a transparent pane 21 is accommodated inside a luminaire body 20. Arranged inside the reflector 13 is a lamp adjusting device, which can be designed as a lamp swivelling device or—as illustrated in FIG. 1—as a lamp carriage 22 on which there are located at a spacing discharge lamps 11, 15 of which one (11) is located in the optical center (focal point) of the reflector 13, while the second discharge lamp 15 is located outside, for example to the side of or below the focal point.

Each of the discharge lamps 11, 15 is connected via a dedicated starting line 23 or 24, respectively, to an individual starting device 12 or 16, respectively, which can optionally be switched on by a switch over arrangement 15. Moreover, the discharge lamps 11, 15 are connected in a way not illustrated in detail to a high-voltage supply which can be switched on in a controlled fashion.

The carriage 22 can be displaced or swivelled out of the position, illustrated in FIG. 1, where the discharge lamp 11 is located at the focal point of the reflector 13, into a position 22', illustrated by dashes, where the discharge lamp 15 is located in a position 15' situated at the focal point on the reflector 13, while the discharge lamp is displaced out of the focal point into the position 11'.

Via a low-voltage control line 26, the switch over arrangement 15 controls the displacement of the carriage 22 synchronously with the switching over to one or other starting device 12, 16 in such a way that whenever the carriage is located in the position illustrated in FIG. 1 by bold lines, the starting device 12 and the assigned voltage supply put the discharge lamp 11 into operation, while the discharge lamp 15 located outside the focal point is switched off.

If the carriage 22 reaches the position 22' illustrated by dashes because the switch over arrangement 15 has been switched over into the other switching position, the operating voltage of the discharge lamp 11 is automatically switched off, and the starting device 12 is also put out of operation. At the same time as, or shortly before the switch over operation, the operating voltage is applied to the discharge lamp 15, and the starting device 16 is also activated. This preferably happens such that the discharge lamp 15 is already started before completion of the switching over of the carriage 22 such that the discharge lamp 15 has already reached its full luminosity after termination of the displacement or swivelling of the carriage 22.

The voltage supply of the lamps is normally performed via a power supply unit 17 which is connected to the network via a mains switch 27 and supplies an operating voltage of 24 V, for example, at its output. The output voltage of the power supply unit 17 is applied via an emergency power change-over switch 28 to the switch over arrangement 25, which is driven by a control unit, in particular a microprocessor 19 which can control the emergency power change-over switch 28.

In the case of mains failure, the microprocessor 19 switches over the emergency power change-over switch 28 instantaneously, and in any event within a time of less than 1 sec, to a battery emergency power supply 18 which supplies at its output the same voltage as the power supply unit 17.

In this way, in the event of a mains failure there is no collapse of the operating voltage at the discharge lamp 11 or 15 currently switched on. The switching over by the emergency power change-over switch 28 must in any event be performed so quickly that the discharge lamp 11 or 15 currently alight is not extinguished during the brief interruption, since restarting is possible only after a certain cooling down time.

The mode of operation of the operating theater luminaire described is as follows:

If, as illustrated by bold lines in FIG. 1, the discharge lamp 11 is located at the focal point of the reflector 13, the switch over arrangement 25 controlled by the microprocessor connects the discharge lamp 11 to the operating high voltage and, moreover, ensures starting via the starting device 12 at the start of operation.

The discharge lamp 11 has a power of 35 W, for example, while the discharge lamp 15 can have a power of 70 W.

The light of the discharge lamp 11 is directed in the usual way via the reflector 13 by the pane 21 to an operating area 14, located below the luminaire body 20, which is illuminated as uniformly as possible.

If it is now desired to illuminate the operating area 14 with an increased light power, the discharge lamp 15 having the higher light power is firstly started via the switch over arrangement 25 by the starting device 16, and the displacement of the carriage 22 into the dashed position according to FIG. 1 is simultaneously initiated. As soon as the carriage 22 has reached the new end position, the starting operation in the discharge lamp 15 is terminated, with the result that instead of the now switched-off discharge lamp 11 it is the fully operating discharge lamp 15 which is located at the focal point of the reflector 13. This results in a doubling of the luminosity in the operating area 14 without there having been a change in the illumination.

In the case of a mains failure, the emergency power supply 18 undertakes immediately and without interruption to supply the discharge lamps 11, 15 and the starting devices 12, 16 and the switch over mechanism for the carriage 22.

The discharge lamps 11, 15 can also have the same power, in which case each time the luminaire is switched on again a change in the switching on of the discharge lamps 11, 15 occurs in such a way that both discharge lamps 11, 15 are used approximately equally often for illuminating the operating area 14. This results in doubling of the service life of the overall discharge lamp arrangement.

The control unit, in particular the microprocessor 19 can, moreover, be programmed such that it establishes the impending failure of a discharge lamp 11 or 15 currently in operation. In this case, it automatically initiates the switching over to the other discharge lamp 15 or 11, with the result that there is in general no interruption in illumination of the operating area 14 and, at most, a slight interruption determined by the starting time, but the operating area 14 is once again illuminated acceptably at the latest after expiry of the starting time of the discharge lamp newly switched on.

Both the power supply unit 17 and the emergency power supply 18 are advantageously installed in the luminaire body. The starting units 12, 16 should be arranged as near as possible to the discharge lamps 11, 15, in order to reduce the EM radiation.

The number of starting operations is to be recorded in order to be able to undertake exchange of the discharge lamps in good time. An exchange of lamps is to be performed, for example, after 20,000 starts or 5000 operating hours.

The power supply unit controller integrated in the microprocessor 19 determines the technical state of the discharge lamp by monitoring whether there has been thermal or electric overloads.

The microprocessor-controlled power supply unit 17 serves the purpose of operating at least two discharge lamps in continuous battery power supply. The power supply unit 17 takes over all the functions of the electronic ballast and drives the required starting unit 12, 16 and the correct lamp 11 or 15.

In principle, the discharge lamps 11, 15 could also be located outside the luminaire body, in which case the light would then be guided via optical conductors or mirrors into the luminaire body.

What is claimed is:

1. An operating theater luminaire arrangement comprising at least two discharge lamps that may be switched on and off, and at least one reflector in which the at least two discharge lamps are arranged, wherein each discharge lamp is equipped with an individual starting device and the at least two discharge lamps are of different powers thereby allowing intensity of illumination in an operating area to be varied when switching over from one discharge lamp to the other discharge lamp of the at least two discharge lamps.

2. A theater luminaire arrangement in accordance with claim 1 wherein the powers of the individual discharge lamps are in a range of 30 W to 40 W.

3. A theater luminaire arrangement in accordance with claim 1 wherein the powers of the individual discharge lamps are in a range of 35 W to 60 W.

4. A theater luminaire arrangement in accordance with claim 1 wherein the powers of the individual discharge lamps are in a range of 50 W to 60 W.

5. A theater luminaire arrangement in accordance with claim 1 wherein the powers of the individual discharge lamps are in a range of 55 W to 80 W.

6. A theater luminaire arrangement in accordance with claim 1 wherein the powers of the individual discharge lamps are in a range of 60 W to 80 W.

7. An operating theater luminaire arrangement comprising at least two discharge lamps that may be switched on and off, and at least one reflector in which the at least two discharge lamps are arranged, wherein all the discharge lamps have the same power, wherein at the end of the service life of one discharge lamp, an automatic switch-over is made to another discharge lamp.

8. A theater luminaire arrangement in accordance with claim 7 wherein prior to the end of the service life of one discharge lamp, an automatic switch-over is made to another discharge lamp.

9. A theater luminaire arrangement in accordance with claim 7 wherein the at least two discharge lamps of the luminaire are switched on alternatively.

10. A theater luminaire arrangement in accordance with claim 7 wherein all the discharge lamps are arranged in a common reflector in a fashion capable of being adjusted in such a way that a respectively started discharge lamp is located in an optical center of the reflector.

11. A theater luminaire arrangement in accordance with claim 10 wherein a control voltage is available for adjusting the position of the discharge lamps inside the reflector.

12. A theater luminaire arrangement in accordance with claim 11 wherein the control voltage is 18 volts.

13. A theater luminaire arrangement in accordance with claim 1 wherein each discharge lamp is arranged in a stationary fashion.

14. A theater luminaire arrangement in accordance with claim 1 wherein the luminaire further comprises a power supply unit fed from a network and an emergency power supply, which in the event of failure of the power supply unit or the network immediately takes over supplying power for any discharge lamp currently lit.

15. A theater luminaire arrangement in accordance with claim 1, wherein the theater luminaire further comprises a microprocessor that drives the at least two discharge lamps and monitors the supply of power and performs continuous self-checking of fault tolerance of the theater luminaire.

16. A method of operating a theater luminaire arrangement, the method comprising providing a theater luminaire arrangement comprising at least two discharge lamps that may be switched on and off and, at least one reflector in which the at least two discharge lamps are arranged, wherein each discharge lamp is equipped with an individual starting device and the at least two discharge lamps are of different powers thereby allowing intensity of illumination in an operating area to be varied when switching over from one discharge lamp to the other discharge lamp of the at least two discharge lamps; and switching off a first of the at least two discharge lamps, and switching on a second of the at least two discharge lamps; wherein the second of the at least two discharge lamps is switched on with a delay in such a way that upon switching off of the first of the at least two discharge lamps, the illumination of the operating area has already started and is substantially largely operational.

17. A method in accordance with claim 16 further comprising adjusting the position of at least one of the discharge lamps inside the reflector.

18. A method in accordance with claim 17 wherein the adjusting of at least one of the discharge lamps is not performed until the at least one discharge lamp has already been switched on.

* * * * *